US005712589A

United States Patent [19]

Afek et al.

[11] Patent Number: 5,712,589

[45] Date of Patent: Jan. 27, 1998

[54] APPARATUS AND METHOD FOR PERFORMING ADAPTIVE POWER REGULATION FOR AN INTEGRATED CIRCUIT

[75] Inventors: Yachin Afek, Cfar Saba; Yuval Itkin, Zoran; Israel Kashat, Netanya, all of Israel

[73] Assignee: Motorola Inc., Schaumburg, Ill.

[21] Appl. No.: 453,111

[22] Filed: May 30, 1995

[51] Int. Cl.[6] ..... G05F 1/10

[52] U.S. Cl. ..... 327/538; 327/540; 327/544; 327/323

[58] Field of Search ..... 327/306, 538, 327/540, 544, 535, 541, 543, 323; 365/229; 323/266

[56] References Cited

U.S. PATENT DOCUMENTS

| | | | |
|---|---|---|---|
| 4,492,876 | 1/1985 | Colbert et al. | 365/229 |
| 4,683,382 | 7/1987 | Sakurai et al. | 327/544 |
| 4,928,056 | 5/1990 | Pease | 327/541 |
| 5,463,585 | 10/1995 | Sanada | 365/227 |
| 5,477,132 | 12/1995 | Canter et al. | 323/282 |

OTHER PUBLICATIONS

Kaenel, Vincent Von, et al., "A Voltage Reduction Technique for Battery-Operated Systems," IEEE Journal of Solid-State Circuits, vol. 25, No. 5, Oct. 1990, pp.1136–1140.

*Primary Examiner*—Timothy P. Callahan
*Assistant Examiner*—Jung Ho Kim
*Attorney, Agent, or Firm*—Susan C. Hill

[57] ABSTRACT

An apparatus and method for performing adaptive power regulation for an integrated circuit. The present invention utilizes a voltage regulator circuit (16) to regulate the voltage provided to an integrated circuit core (12), and to thereby reduce the power consumption of the integrated circuit core (12). In one form, the voltage regulator circuit (16) utilizes two voltage converting mechanisms, namely an inductive converter (22) and a resistive converter (24). The inductive converter (22) and the resistive converter (24) supplement each other in order to supply the current required by integrated circuit core (12). All or a portion of voltage regulator (16) may be located on the same integrated circuit substrate as integrated circuit core (12).

21 Claims, 7 Drawing Sheets

APPARATUS AND METHOD FOR PERFORMING ADAPTIVE POWER REGULATION FOR AN INTEGRATED CIRCUIT

FIELD OF THE INVENTION

The present invention relates in general to integrated circuits, and more particularly to an apparatus and method for performing adaptive power regulation for an integrated circuit.

BACKGROUND OF THE INVENTION

Reducing the power consumed by integrated circuits is very important, especially as more and more products utilizing integrated circuits become portable and use a battery as a power source (e.g. portable computers, pagers, portable telephones).

DESCRIPTION OF THE PREFERRED EMBODIMENT

Figure 2:
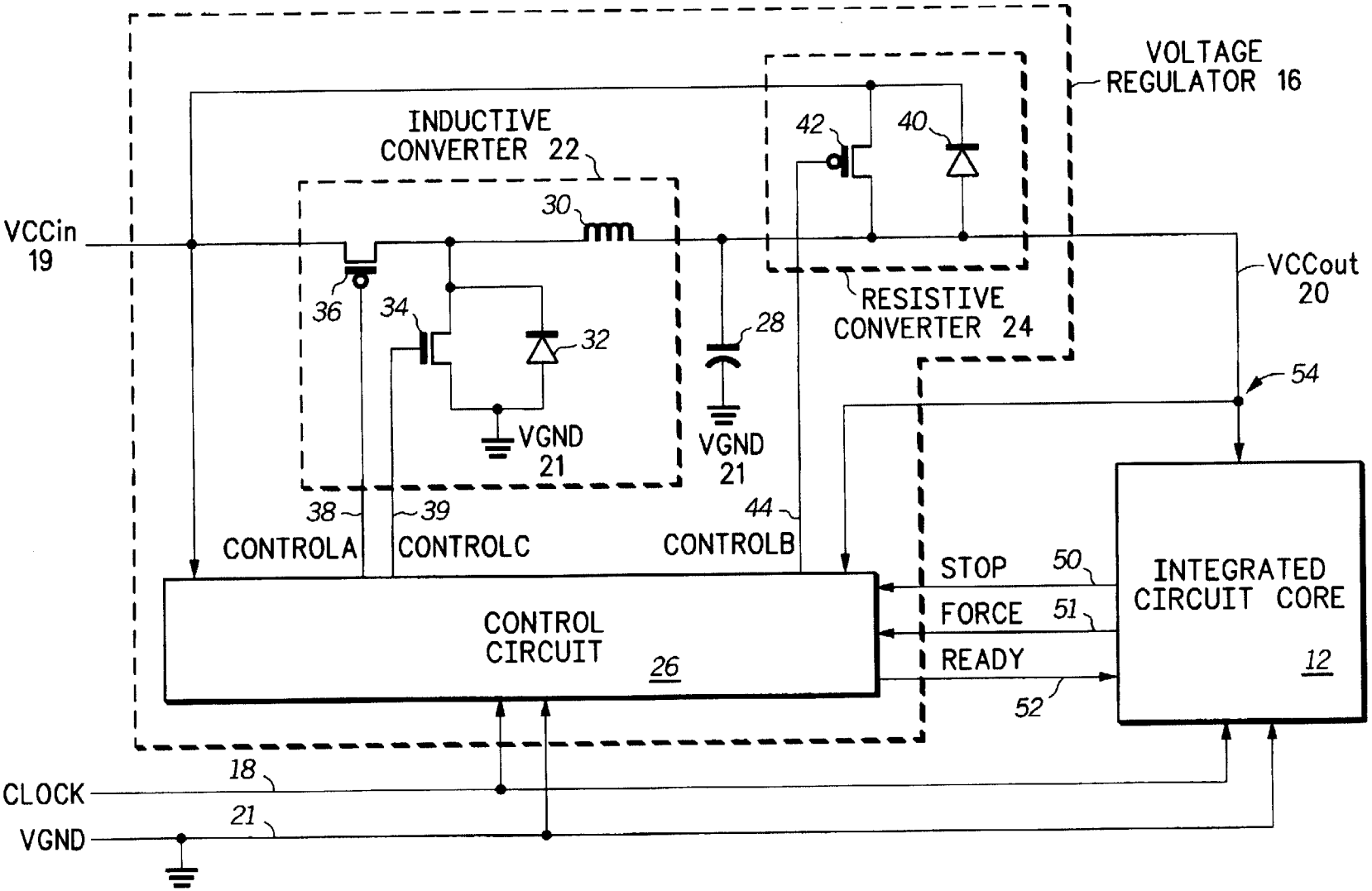
FIG. 2 illustrates, in partial block diagram form and partial schematic diagram form, voltage regulator 16 and integrated circuit core 12 of FIG. 1 in accordance with one embodiment of the present invention.

Referring to FIG. 2, the present invention utilizes a voltage regulator circuit 16 to reduce the power consumed by the digital sections of an integrated circuit core 12. The present invention continuously provides the integrated circuit core 12 with a regulated power supply voltage VCCout that is as low as possible to reduce power consumption, yet which is high enough to enable the integrated circuit core 12 to operate at the desired frequency. The voltage level of the regulated power supply voltage VCCout which must be provided to the integrated circuit core 12 will depend on the maximum frequency at which the integrated circuit core 12 can operate at a given ambient temperature, compared to the actual required frequency at that ambient temperature. A change in the frequency of operation of the integrated circuit core 12 will result in a change of the voltage level of the regulated power supply voltage VCCout which must be provided to the integrated circuit core 12.

The voltage regulator 16 illustrated in FIG. 2 utilizes two modes of voltage conversion. Inductive converter 22 is controlled by control signals CONTROLA and CONTROLC, and resistive converter 24 is controlled by control signal CONTROLB. The inductive converter 22 operates basically by switching the input voltage at a variable pulse width, such that the average voltage of the pulsed output equals the power supply voltage required by integrated circuit core 12. One advantage to using inductive regulator 22 is that inductive regulator 22 does not consume much power. By using a p-channel field effect transistor 36 that has a very low resistance when conducting, inductive converter 22 can operate very efficiently. On the other hand, resistive converter 24, which operates as a linear regulator, consume much more power because it uses only resistive series elements which dissipate more power.

The mode of conversion used by inductive converter 22 and the mode of conversion used by resistive converter 24 complement each other. The inductive mode used by inductive converter 22 operates at a higher efficiency when current spikes of the integrated circuit core 12 are moderated and can be smoothed out by the capacitor 28. The resistive mode used by resistive converter 24 operates in various cases: (1) abrupt current steps that lasts for approximately 1 microsecond or more will cause the voltage regulator 16 to move on its own into the resistive mode; (2) when the operating frequency of integrated circuit core 12 is changed; and (3) when integrated circuit core 12 enters stop mode the voltage regulator 16 is forced into the resistive mode.

Figure 1:
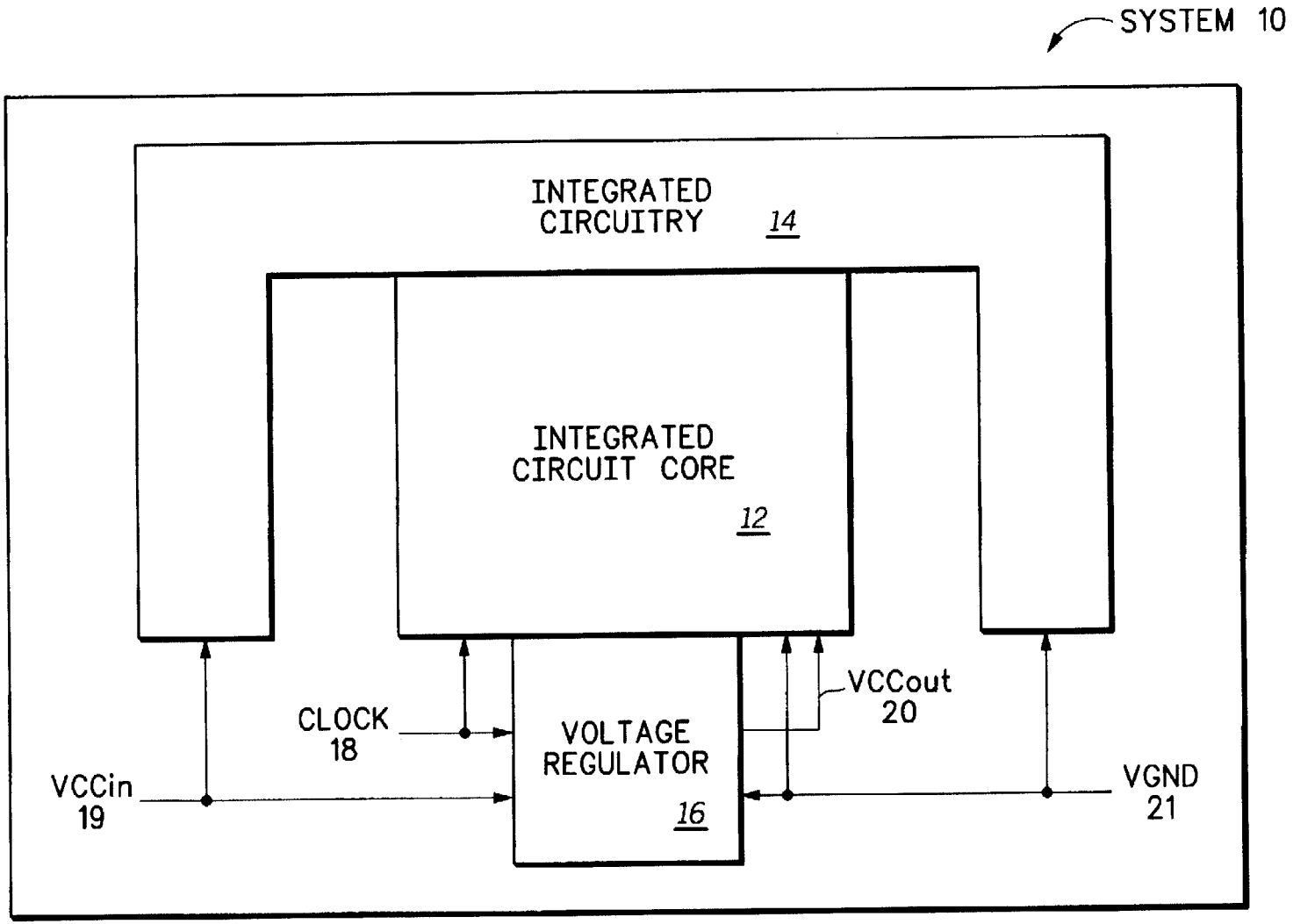
FIG. 1 illustrates, in block diagram form, a system 10 in accordance with one embodiment of the present invention.

Some circuitry on an integrated circuit must still receive the non-regulated power supply voltage VCCin in order to operate properly. For example, external input/output buffers, analog circuitry, phase-lock loops, crystal oscillator circuitry, and certain other types of circuits may need to receive the non-regulated power supply voltage VCCin in order to operate properly. Integrated circuitry 14 in FIG. 1 represents the various circuitry on an integrated circuit which must still receive the non-regulated power supply voltage VCCin in order to operate properly. However, a significant amount of the circuitry on an integrated circuit, represented by integrated circuit core 12, will be able to operate properly using the regulated power supply voltage VCCout. Thus, the power consumed by an integrated circuit may be reduced by utilizing voltage regulator 16.

Figure 4:
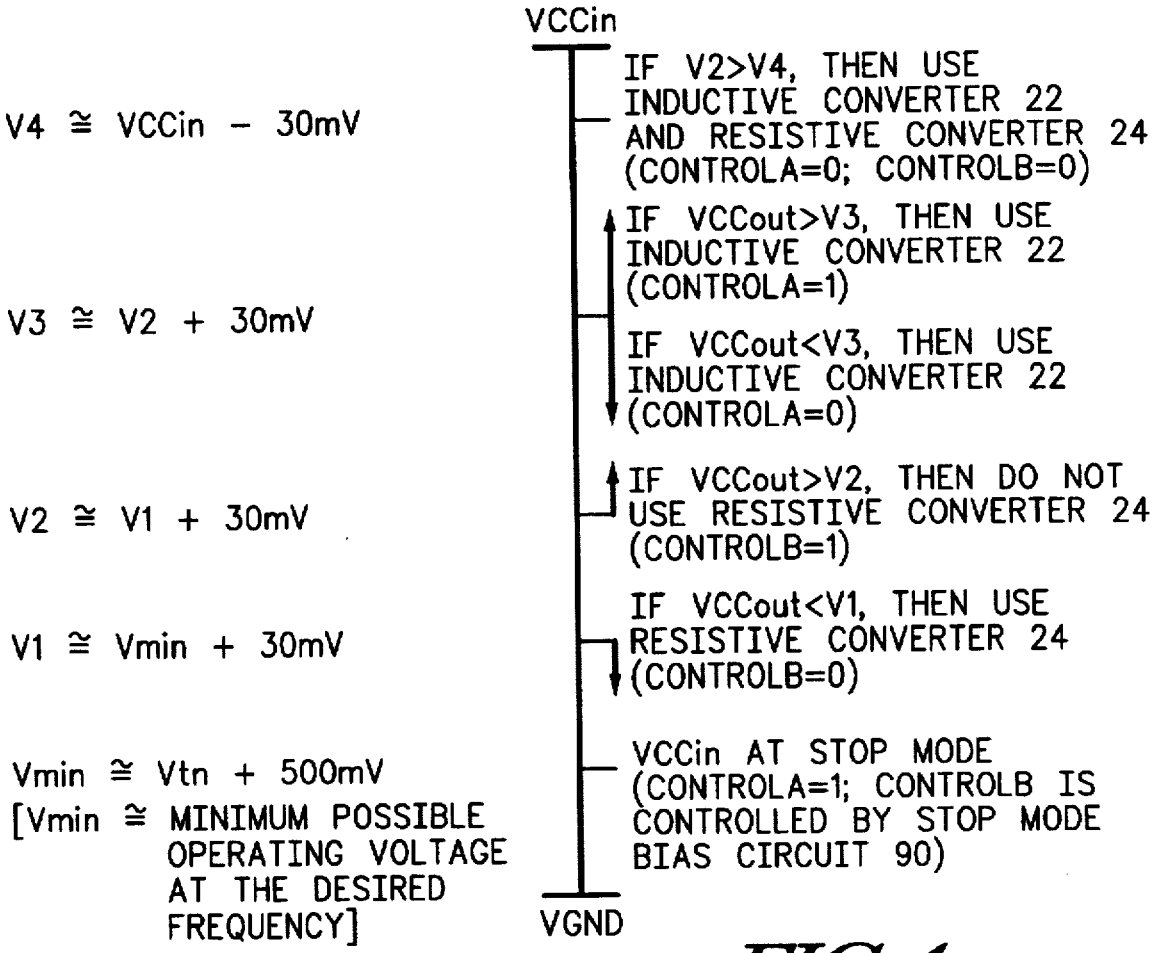
FIG. 4 illustrates, in graphical form, the operation of voltage regulator 16 of FIG. 2 in accordance with one embodiment of the present invention.

The only required relationship between "power" (VCCin and VCCout) and "ground" (VGND) as illustrated in FIGS. 1, 2, and 4 is that the potential of power must be more positive than the potential of ground. In the preferred embodiment, a logic level zero represents approximately the potential of ground and a logic level one represents approximately the potential of the positive power supply being applied to the circuit.

The terms "assert" and "negate" will be used when referring to the rendering of a signal, status bit, or similar apparatus into its logically true or logically false state, respectively. If the logically true state is a logic level one, the logically false state will be a logic level zero. And if the logically true state is a logic level zero, the logically false state will be a logic level one.

Power may be calculated by multiplying voltage by current (i.e. Power=Voltage×Current). Note that an asterisk (*) after a signal name indicates that the signal is a logical complement of a signal having the same name but lacking the asterisk (*). For example, in FIG. 7, signal Q* is a logical complement of signal Q.

DESCRIPTION OF THE FIGURES

FIG. 1 illustrates a system 10. System 10 includes integrated circuit core circuitry 12, integrated circuitry 14, and a voltage regulator circuit 16, which are all bi-directionally coupled to each other. Voltage regulator 16 and integrated circuitry 14 each receives a non-regulated power supply voltage VCCin by way of conductor 19. Voltage regulator 16, integrated circuit core 12, and integrated circuitry 14 each receives a ground power supply voltage VGND by way of conductor 21. Voltage regulator 16 and integrated circuit core 12 each receives a clock signal labeled CLOCK by way of conductor 18. In some embodiments of the present invention, the CLOCK signal 18 is provided by a phase lock loop circuit (not shown) within integrated circuitry 14. In alternate embodiments of the present invention, the CLOCK signal 18 is provided from a dock source (not shown) which is external to system 10. Voltage regulator generates and provides a regulated power supply voltage VCCout to integrated circuit core 12 by way of conductor 20.

In some embodiments of the present invention, a significant portion of integrated circuit core 12 is digital circuitry. Integrated circuit core 12 may include any type of digital circuitry. For example, integrated circuit core 12 may include a data processor core, or the core processing portion of any type of integrated circuit.

FIG. 2 illustrates voltage regulator 16 and integrated circuit core 12 of FIG. 1 in accordance with one embodiment of the present invention. Voltage regulator 16 includes an inductive converter 22, a resistive converter 24, a control circuit 26, and a capacitive element 28. Inductive converter 22 includes an inductive element 30, a diode 32, a n-channel field effect transistor 34, and a p-channel field effect transistor 36. Note that transistor 34 is optional and alternate embodiments of the present invention may not use transistor 34 and control signal CONTROLC 39. Resistive converter 24 includes a diode 40 and a p-channel field effect transistor 42. Integrated circuit core 12 provides a STOP signal to control circuit 26 by way of conductor 50, and provides a FORCE signal to control circuit 26 by way of conductor 51. Control circuit 26 provides a READY signal to integrated circuit core 12 by way of conductor 52. Control circuit 26 and integrated circuit core 12 each receive the CLOCK signal by way of conductor 18. Control circuit 26 and integrated circuit core 12 each receive the ground power supply voltage VGND by way of conductor 21.

A first current electrode of transistor 36 is coupled to receive the non-regulated power supply voltage VCCin by way of conductor 19. A second current electrode of transistor 36 is coupled to a first terminal of inductive element 30. A gate electrode of transistor 36 is coupled to control circuit 26 by way of conductor 38 for receiving a CONTROLA signal. The first terminal of inductive element 30 is also coupled to a first current electrode of transistor 34 and to a first current electrode of diode 32. A second current electrode of transistor 34 is coupled to the ground power supply voltage VGND by way of conductor 21. A second current electrode of diode 32 is coupled to the ground power supply voltage VGND by way of conductor 21. A gate electrode of transistor 34 is coupled to control circuit 26 by way of conductor 39 for receiving a CONTROLC signal.

A second terminal of inductive element 30 is coupled to a first terminal of capacitive element 28. A second terminal of capacitive element 28 is coupled to the ground power supply voltage VGND by way of conductor 21.

A first current electrode of transistor 42 is coupled to receive the non-regulated power supply voltage VCCin by way of conductor 19. A second current electrode of transistor 42 is coupled to the first terminal of capacitive element 28. A gate electrode of transistor 36 is coupled to control circuit 26 by way of conductor 44 for receiving a CONTROLB signal. A first current electrode of diode 40 is coupled to the first current electrode of transistor 42. A second current electrode of diode 40 is coupled to the second current electrode of transistor 42 at node 54. Integrated circuit core 12 is coupled to voltage regulator 16 at node 54 for receiving the regulated power supply voltage VCCout. Control circuit 26 is coupled to node 54 for receiving the regulated power supply voltage VCCout.

Figure 3:
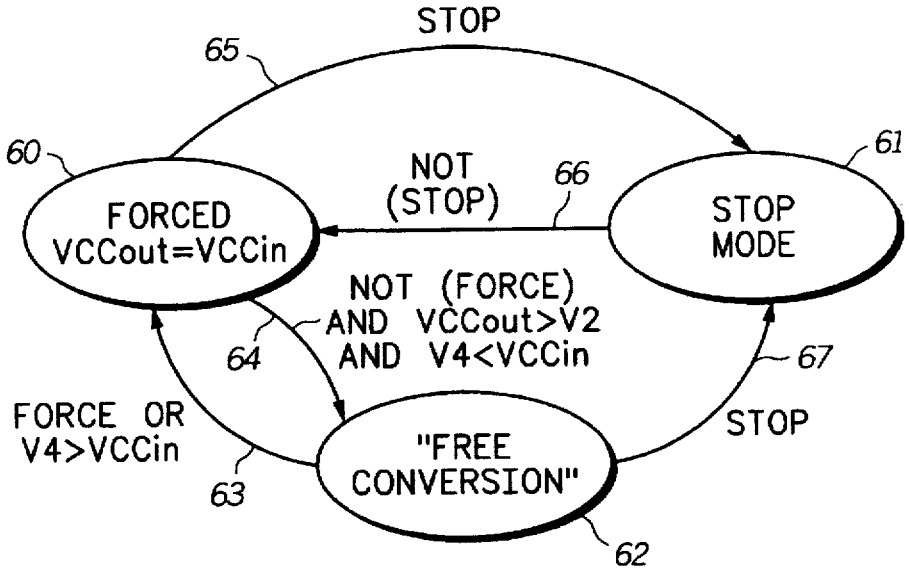
FIG. 3 illustrates, in state diagram form, the operation of control circuit 26 of FIG. 2 in accordance with one embodiment of the present invention.

FIG. 3 illustrates, in state diagram form, the operation of control circuit 26 of FIG. 2 in accordance with one embodiment of the present invention. In one embodiment of the present invention, state machine 91 (see FIG. 9) implements the functionality of the state diagram illustrated in FIG. 3. in one embodiment, state machine 91 may have three states, namely a "forced VCCout=VCCin" state 60, a "Stop Mode" state 61, and a "free conversion" state 62. See FIG. 4 for definitions of V2 and V4.

If integrated circuit core 12 asserts the STOP signal while state machine 91 is in the "free conversion" state 62, then state machine 91 transitions to state 61 by way of path 67. If an input to state machine 91 (e.g. the Q output from flip-flop 75 in FIG. 7) indicates that V4>VCCin, or if integrated circuit core 12 asserts the FORCE signal while state machine 91 is in the "free conversion" state 62, then state machine 91 transitions to state 60 by way of path 63. If integrated circuit core 12 negates the STOP signal 50 while state machine 91 is in the "Stop Mode" state 61, then state machine 91 transitions to state 60 by way of path 66. If integrated circuit core 12 asserts the STOP signal 50 while state machine 91 is in the "forced VCCout=VCCin" state 60, then state machine 91 transitions to state 61 by way of path 65. And, if integrated circuit core 12 has not asserted the FORCE signal, if VCCout<V2, and if V4>VCCin, then state machine 91 transitions to state 62 by way of path 64. Alternate embodiments of the present invention may utilize different states and different state transitions than those illustrated in FIG. 3.

FIG. 4 illustrates the operation of voltage regulator 16 of FIG. 2 in relation to the voltage levels of the non-regulated power supply voltage VCCin, the regulated power supply voltage VCCout, and the minimum possible operating voltage at a desired frequency Vmin. Note that alternate embodiments of the present invention may select more, fewer, and/or different voltage relationships that those illustrated in FIG. 4.

Still referring to FIG. 4, the relevant voltage levels for one embodiment of the present invention are as follows. Vmin is the minimum possible operating voltage at a desired frequency. For example. Note that Vmin will vary as the desired frequency varies. The lowest voltage level for Vmin occurs when integrated circuit 12 is in Stop Mode. In one embodiment of the present invention, Vmin is approximately equal to the threshold voltage of an n-channel field effect transistor (e.g. transistor 34 in FIG. 2) plus 500 millivolts. V1 is the minimum possible operating voltage at the desired frequency. In one embodiment of the present invention, V1 is approximately equal to Vmin plus 30 millivolts. In one embodiment of the present invention, V2 is approximately equal to V1 plus 30 millivolts. In one embodiment of the present invention, V3 is approximately equal to V2 plus 30 millivolts. And, in one embodiment of the present invention, V4 is approximately equal to VCCin minus 300 millivolts. Of course, alternate embodiments of the present invention may define Vmin, V1, V2, V3, and V4 as different voltage levels.

Figure 5:
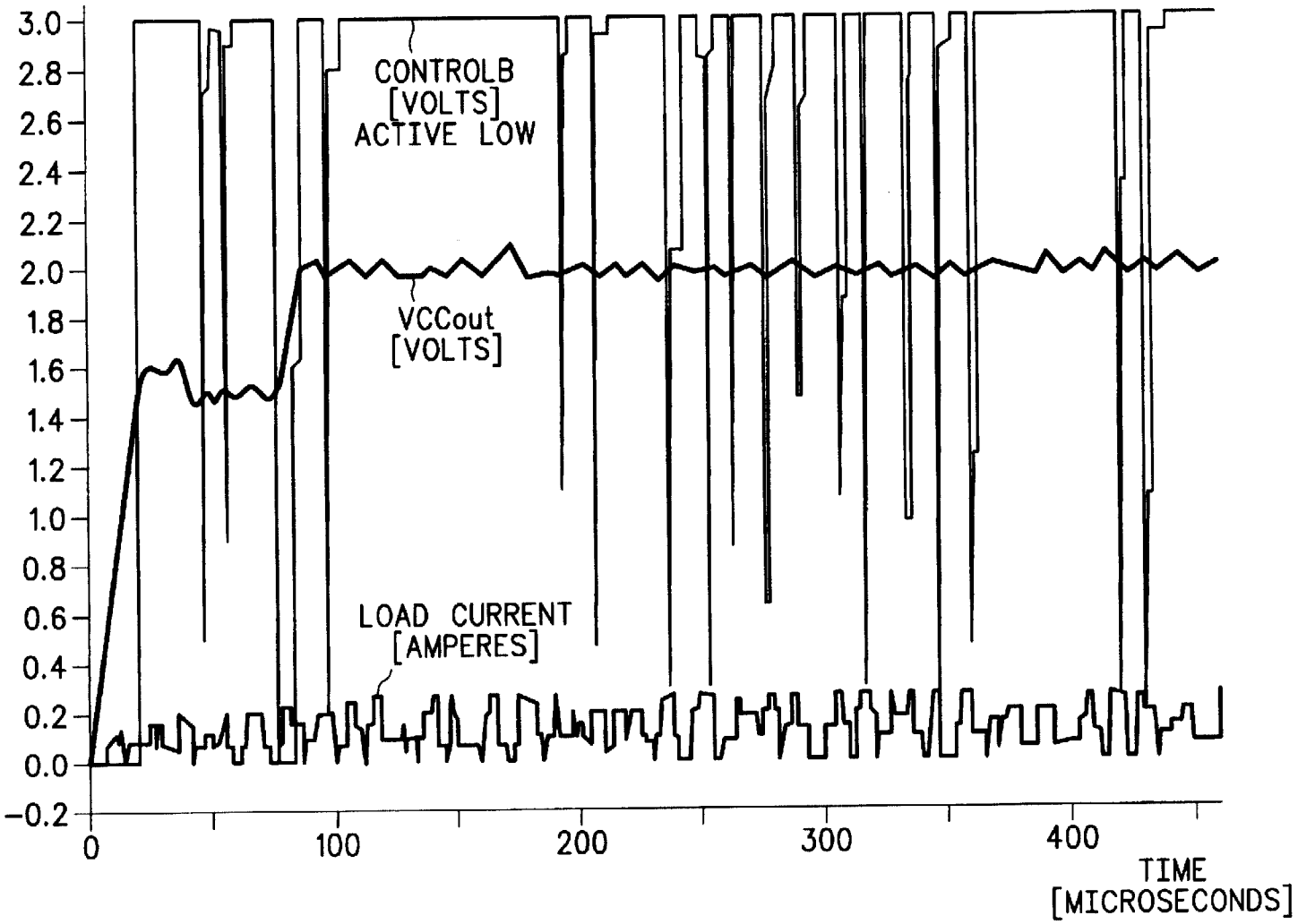
FIG. 5 illustrates simulated waveforms of various signals of the circuitry illustrated in FIG. 2 in accordance with one embodiment of the present invention.
Figure 6:
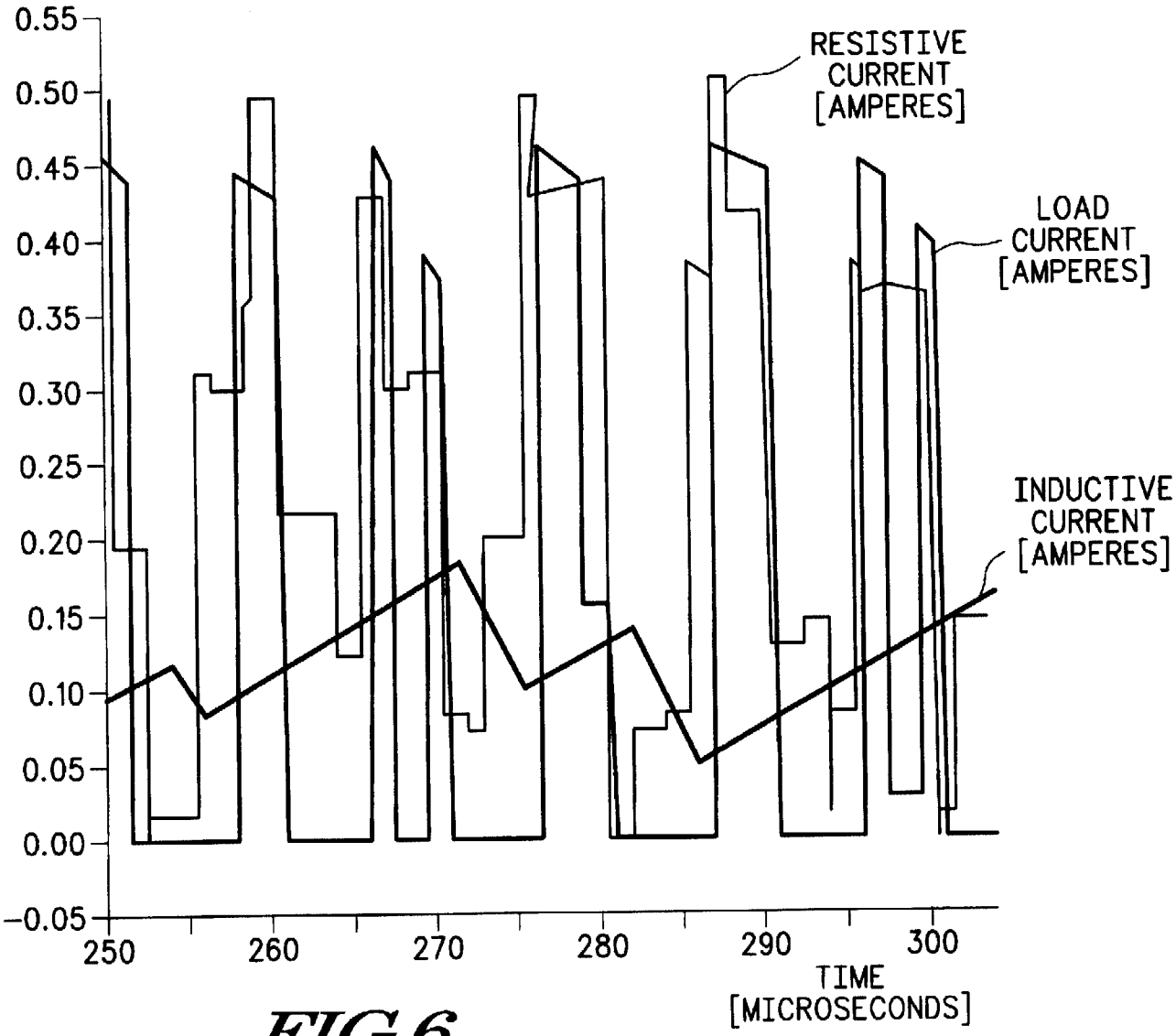
FIG. 6 illustrates simulated waveforms of various signals of the circuitry illustrated in FIG. 2 in accordance with one embodiment of the present invention.

FIGS. 5–6 illustrate simulated waveforms of various signals of the circuitry illustrated in FIG. 2 in accordance with one embodiment of the present invention. The waveforms illustrated in FIGS. 5–6 will be discussed further herein below.

Figure 7:
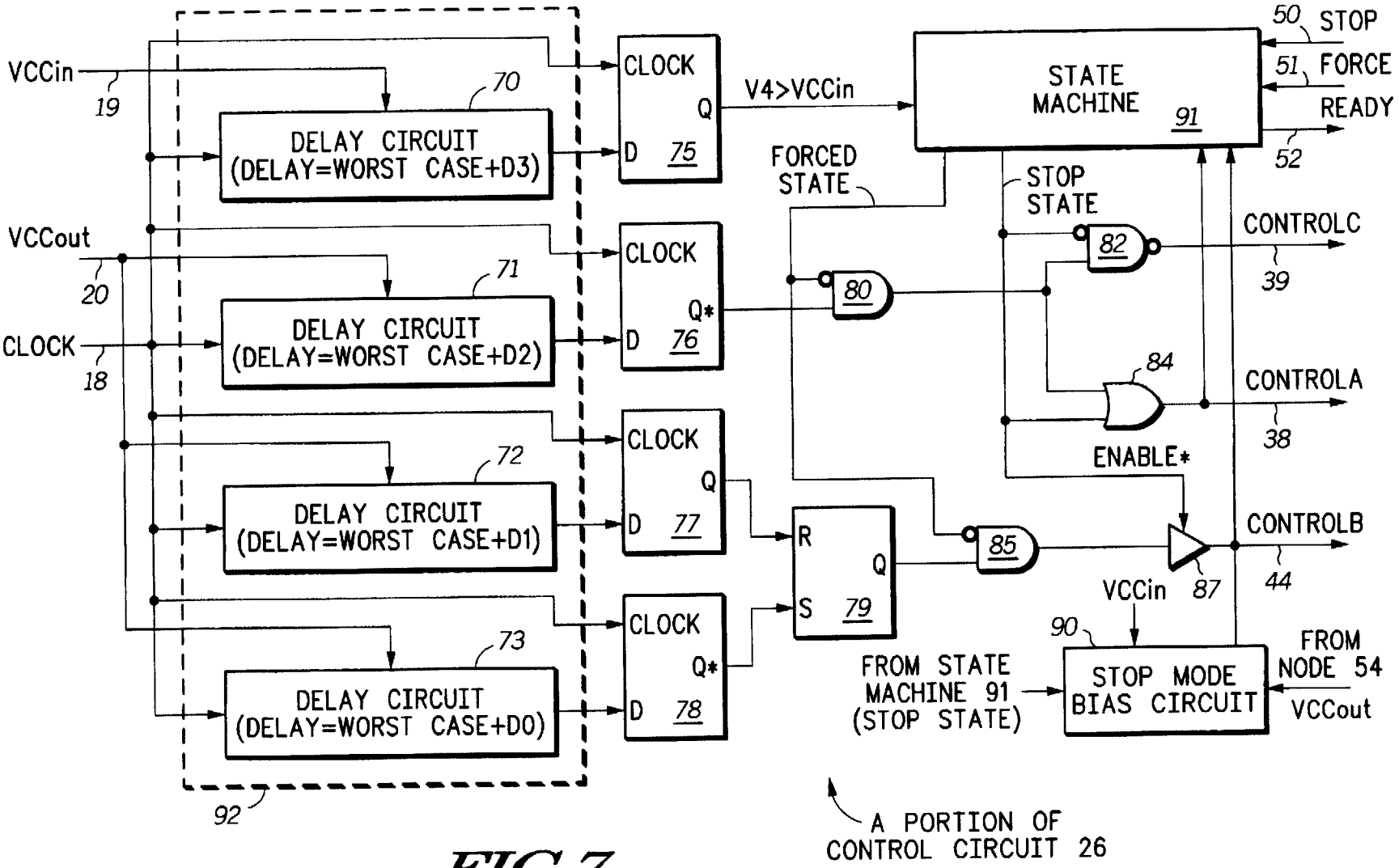
FIG. 7 illustrates, in partial block diagram form and partial logic diagram form, a portion of control circuit 26 of FIG. 2 in accordance with one embodiment of the present invention.

FIG. 7 illustrates a portion of control circuit 26 of FIG. 2 in accordance with one embodiment of the present invention. In one embodiment of the present invention, control circuit 26 includes delay circuits 70–73. In alternate embodiments of the present invention, delay circuits 70–73 may be implemented by one delay line circuit 92 that has multiple taps at different points along the delay line to allow delays of varying length (e.g. worst case delay, D0, D1, D2, and D3).

In one embodiment of the present invention, delay circuit 70 receives the non-regulated input supply voltage VCCin as an input by way of conductor 19, and delay circuits 71–73 receive the regulated power supply voltage VCCout as an input by way of conductor 20. Note that all of the circuitry illustrated in FIG. 7 receives the ground power supply voltage VGND by way of conductor 21 (not explicitly shown).

Control circuit 26 also includes D flip-flops 75–78. Each one of flip-flops 70–73 receives the CLOCK signal at its respective clock input by way of conductor 18. Each one of delay circuit 70–73 receives the CLOCK signal by way of conductor 18. Delay circuit 70 is coupled to the D input of flip-flop 75, delay circuit 71 is coupled to the D input of flip-flop 76, delay circuit 72 is coupled to the D input of flip-flop 77, and delay circuit 73 is coupled to the D input of flip-flop 78. The Q output of flip-flop 75 is coupled to state machine 91 for providing the information as to whether V4<VCCin. State machine 91 receives a STOP signal from integrated circuit core 12 by way of conductor 50. State machine 91 receives a FORCE signal from integrated circuit core 12 by way of conductor 51. State machine 91 provides a READY signal to integrated circuit core 12 by way of conductor 52.

State machine 91 provides a FORCED STATE signal which is asserted when state machine 91 is in the "forced VCCout=VCCin" state 60 (see FIG. 3). And, state machine 91 provides a STOP STATE signal which is asserted when state machine 91 is in the "Stop Mode" state 61 (see FIG. 3). State machine 91 is coupled to a first negated input of AND-gate 80 and to a first negated input of AND-gate 85 to provide the FORCED STATE signal. State machine 91 is coupled to a first negated input of NAND-gate 82, to a second input of OR-gate 84, to an input of stop mode bias circuit 90, and to an ENABLE* input of buffer 87 to provide the STOP STATE signal.

The Q output of flip-flop 77 is coupled to the reset input of a RS flip-flop 79. The Q* output of flip-flop 78 is coupled to the set input of RS flip-flop 79. The Q output of flip-flop 79 is coupled to a second input of AND-gate 85. The Q* output of flip-flop 76 is coupled to a second input of AND-gate 80. The output of AND-gate 80 is coupled to a first input of OR-gate 84 and to a second input of NAND-gate 82. The output of OR-gate 84 is coupled to state machine 91 and to inductive converter 22 (see FIG. 2) for providing the CONTROLA signal by way of conductor 38. The output of NAND-gate 82 is coupled to inductive converter 22 (SEE FIG. 2) to provide the CONTROLC signal by way of conductor 39. The output of AND-gate 85 is coupled to the input of buffer 87. The output of buffer 87 and an output of stop mode bias circuit 90 are coupled together and are coupled to state machine 91 and to resistive converter 24 (SEE FIG. 2) for providing the CONTROLB signal by way of conductor 44. Stop mode bias circuit 90 is coupled to node 54 (see FIG. 2) for receiving VCCout, and is coupled to conductor 19 for receiving VCCin.

Figure 8:
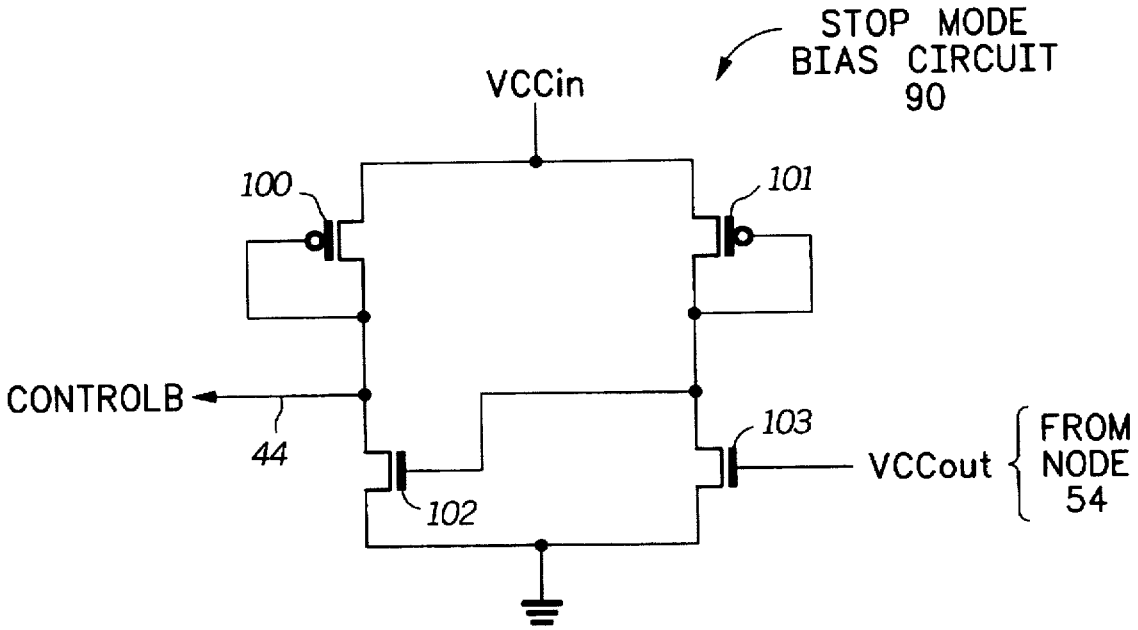
FIG. 8 illustrates, in schematic diagram form, a stop mode bias circuit 90 of FIG. 7 in accordance with one embodiment of the present invention.

FIG. 8 illustrates a stop mode bias circuit 90 of FIG. 7 in accordance with one embodiment of the present invention. Stop mode bias circuit 90 includes a p-channel field effect transistor 100, a p-channel field effect transistor 101, a n-channel field effect transistor 102, and a n-channel field effect transistor 103. A first current electrode of transistor 100 and a first current electrode of transistor 101 are coupled to VCCin (e.g. by way of conductor 19 in FIG. 2) to receive power. A second current electrode of transistor 100 is coupled to a gate electrode of transistor 100. A second current electrode of transistor 101 is coupled to a gate electrode of transistor 101 and to a gate electrode of transistor 102. The second current electrode of transistor 100 is coupled to a first current electrode of transistor 102 for providing the CONTROLB signal by way of conductor 44. The second current electrode of transistor 101 is coupled to a first current electrode of transistor 103. A gate electrode of transistor 103 is coupled to node 54 (see FIG. 2) for receiving VCCout. A second current electrode of transistor 102 and a second current electrode of transistor 103 is coupled to a ground power supply voltage (e.g. VGND by way of conductor 21 in FIG. 2)

OPERATION OF THE PREFERRED EMBODIMENT

The operation of system 10 and the voltage regulator circuit 16 of FIGS. 1 and 2 will now be described. The circuitry within integrated circuit core 12 may operate in the same manner as the circuitry of various prior art integrated circuit cores, except for the fact that integrated circuit core 12 receives a regulated power supply voltage VCCout and a control signal READY from voltage regulator 16, and the fact that integrated circuit core 12 provides a STOP signal and a FORCE signal to voltage regulator 16. Control circuit 26 (see FIG. 2) senses the input clock signal CLOCK and the regulator output VCCout and produces the control signals CONTROLA, CONTROLC, and CONTROLB, which activate the proper conversion modes.

The "forced VCCout=VCCin" state 60 (see FIG. 3), is entered when V4>VCCin or when integrated circuit core 12 asserts the FORCE signal. In one embodiment of the present invention, integrated circuit core 12 asserts the FORCE signal during power-on reset, and when the operating frequency is being changed from a lower frequency to a higher frequency. The "forced VCCout=VCCin" state 60 is exited and the "free conversion" state 62 is entered if VCCout>V2, if integrated circuit core 12 negates the FORCE signal, and if V4<VCCin.

The assertion of the FORCE signal by integrated circuit core 12 causes control circuit 26 to enter a "Forced Mode"in which control circuit 26 negates signals CONTROLA and CONTROLB so that transistors 36 and 42 are conducting and transistor 34 is non-conducting, thus producing VCCout=VCCin. In one embodiment of the present invention, Forced Mode is used in two cases. The first case is when integrated circuit core 12 asserts the FORCE signal (see transition 66 in FIG. 3), which may be done by integrated circuit core 12 for power-on reset, for exiting "Stop Mode", or for any other abrupt change in the operating frequency of the integrated circuit core 12. The second case is when control circuit 26 determines that the desired voltage level of VCCout is very close to the actual voltage level of VCCin. In this second case, control circuit 26 enters Force-Mode-on its own (see transition 63 in FIG. 3), and negates signals CONTROLA and CONTROLB so that transistors 36 and 42 are conducting and transistor 34 is non-conducting, thus producing VCCout=VCCin.

The assertion of the STOP signal by integrated circuit core 12 causes control circuit 26 to enter a "Stop Mode" (see state 61 in FIG. 3) in which control circuit 26 drives a logic level one on signal CONTROLA, drives a logic level zero on signal CONTROLC, and tri-states (i.e. high impedance) signal CONTROLB so that only the stop mode bias circuit 90 is driving the CONTROLB signal. As a result, transistors 34 and 36 are non-conducting and transistor 42 is controlled by the current provided by stop mode bias circuit 90, thus producing VCCout=Vmin, where Vmin is the minimum voltage at which the integrated circuit core 12 can maintain its current state during Stop Mode. Using the minimum possible operating voltage Vmin during Stop Mode reduced the leakage power which is consumed during Stop Mode. In Stop Mode, the clock signal 18 is stopped and integrated circuit core 12 stops performing operations and/or executing instructions.

One purpose of the Stop Mode is to reduce the power consumed by integrated circuit core 12 when it is not needed to perform operations or execute instructions. In one embodiment, when integrated circuit core 12 enters Stop Mode, it stops performing operations or executing instructions and utilizes power only to store and retain necessary data and state information. In one embodiment of the present invention, VCCout is forced into a minimal voltage that is slightly higher than Vtn when integrated circuit core 12 is in Stop Mode. Note that Vtn is the threshold voltage of an n-channel transistor, such as transistor 34 in FIG. 2.

In some embodiment of the present invention, forcing VCCout to a minimal voltage that is slightly higher than Vtn reduces the leakage current during Stop Mode by a factor of two or more. Referring to FIG. 3, "Stop Mode" state 61 is entered when integrated circuit core 12 asserts the STOP signal, and is exited when integrated circuit core 12 negates the STOP signal. Once integrated circuit core 12 negates the STOP signal, it then monitors the READY signal. Integrated circuit core 12 does not resume operation until control circuit 26 asserts the READY signal. In one embodiment of the present invention, the time delay between the negation of the STOP signal and the assertion of the READY signal is in the range of 1–5 microseconds. This delay may be shorter or longer for alternate embodiments of the present invention.

When the input frequency (i.e. clock 18) changes from a lower frequency to a higher frequency, the integrated circuit core 12 will go into a wait state while it adjusts to the new higher frequency clock. When integrated circuit core 12 receives the asserted READY signal from control circuit 26, the integrated circuit core 12 releases itself from this wait state. The READY signal is asserted by state machine 91 when the CONTROLB signal is a logic level one.

Alternate embodiments of the present invention may use a different state machine than the one illustrated in FIG. 3. In addition, alternate embodiments of the present invention may use sequential logic, programmable logic arrays, or any other type of circuitry to implement the control of voltage regulator 16.

The operation of control circuit 26 will now be discussed. In one embodiment of the present invention, voltage regulator 16 is controlled by control circuit 26. Referring to FIG. 3, in one embodiment of the present invention, control circuit 26 may control voltage regulator 16 by way of a state machine with three states.

During the "free conversion" state 62, control circuit 26 activates one or both of inductive converter 22 and resistive converter 24 in order to achieve the best efficiency. In the "free conversion" state 62, the choice of values for inductive element 30 and capacitor 28 effect the efficiency of conversion by assuring that voltage regulator 16 will operate primarily using inductive converter 22, rather than resistive converter 24. The values for inductive element 30 and capacitor 28 may be selectively adjusted for different integrated circuit cores 12 such that voltage regulator 16 will primarily utilize inductive converter 22 in order to produce optimal power savings. In one embodiment of the present invention, inductive element 30 has a value of 100 microhenrys and capacitive element 28 has a value of 10 microfarads. Alternate embodiments of the present invention may use different values for inductive element 30 and capacitive element 28. A useful range of values for inductive element 30 in the circuit illustrated in FIG. 2 is 20 microhenrys to 200 microhenrys; however, alternate embodiments of the circuit in FIG. 2 may use a value for inductive element 30 which is outside of this range.

In one embodiment, control circuit 26 can be modeled as a voltage comparator. Based on the relative voltage levels of VCCin and VCCout, control circuit 26 drives control signals CONTROLA, CONTROLC, and CONTROLB so that selected ones of transistors 34, 36, and 42 are conducting, and the remaining ones of transistors 34, 36, and 42 are not conducting. In a conceptual sense then, transistors 36, 34, and 42 are functioning as switches which are opened (disconnect) and closed (connect) by the control signals CONTROLA, CONTROLC, and CONTROLB, respectively.

Referring to FIGS. 2 and 4, control circuit 26 determines which logic level to drive on control signals CONTROLA, CONTROLC, and CONTROLB. If V2>V4, then control circuit 26 drives CONTROLA with a logic level zero and transistor 36 is conducting, control circuit 26 drives CONTROLC with a logic level zero and transistor 34 is not conducting, and control circuit 26 drives CONTROLB with a logic level zero and transistor 42 is conducting.

If VCCout<V3, then control circuit 26 drives CONTROLA with a logic level one and transistor 36 is non-conducting, and control circuit 26 drives CONTROLC with a logic level one and transistor 34 is conducting.

If VCCout>V2, then control circuit 26 drives CONTROLB from a logic level one to a logic level zero, and consequently transistor 42 is made non-conducting.

If VCCout<V1, then control circuit 26 drives CONTROLB with a logic level one and transistor 42 is conducting.

The inductive converter 22 will operate at its natural frequency of 10–100 kilohertz. To ensure that inductive converter 22 will not oscillate at a higher frequency, the control circuit 26 slowly (approximately 1 microsecond) transitions transistors 34 and 36 from their non-conducting state to their conducting state, and quickly (approximately 10–100 nanoseconds) transitions transistors 34 and 36 from their conducting state to their non-conducting state. This ensures that the VCCout voltage ripple will be at the natural frequency of the inductor-capacitor network, namely inductor 30 and capacitor 28, with a small ripple size around 30–50 millivolts.

Transistor 34 is used to increase the converter efficiency; however, the use of transistor 34 is optional. Alternate embodiments of the present invention may omit transistor 34.

In one embodiment of the present invention, the resistive converter 24 operates with hysteresis since VI<V2. The voltage difference between V1 and V2 controls the switching frequency of transistor 42 to about 100–500 kilohertz.

In one embodiment of the present invention, control circuit 26 utilizes a clock signal 18 that is faster than the control switching which control circuit 26 must perform by asserting and negating signals CONTROLA, CONTROLC, and CONTROLB. In one embodiment of the present invention, controls switching of less than 500 kilohertz requires that the CLOCK signal be at least 1 megahertz.

FIG. 5 illustrates simulation results of one embodiment of the circuitry illustrated in FIG. 2 assuming VCCin equals 3 volts, VCCout equals 1.5 volts and then 2.0 volts, capacitor 28 equals 10 picofarads, and inductor 30 equals 100 henry. For purposes of the simulation, the load caused by integrated circuit core 12 was modeled as a switched resistor array. Current consumption is displayed at the bottom of the diagram in FIG. 5. For this embodiment of voltage converter 16, the worst case conditions are current oscillations at a period of 2–3 seconds. FIG. 5 shows that at an average current consumption of 125 milliamperes, voltage converter 16 will very seldom activate resistive converter 24 by driving CONTROLB to a logic level zero. According to the simulation, this results in approximately 85% efficiency for this embodiment of voltage regulator 16.

FIG. 5 illustrates that the voltage swing on VCCout is never more than 50 nillivolts when V3=2 volts. As VCCout gets smaller, with the same VCCin and the same current consumption by integrated circuit core 12, the less often the resistive converter 24 is utilized and the smaller the oscillations on VCCout. At a fixed VCCin, the current consumption time variation defines the VCCout variations, and thus affects how often the resistive converter 24 is utilized.

Referring to FIG. 6, the simulation illustrated in FIG. 6 assumes inductive element 30 is 100 microhenrys, capacitor 28 is 10 microfarads, VCCout=2 volts, and VCCin=3 volts. The values of inductor 30 and capacitor 28 may be selected to minimize the VCCout ripple and to maximize the change in current divided by the change in time. In general inductive converter 22 tries to supply as much current as it can, and resistive converter 24 supplements the total current so that the required amount of current is provided to integrated circuit core 12. FIG. 6 illustrates the simulation results of a case where CONTROLA and CONTROLB are changing logic levels frequently due the nature of the current consumption activity relative to the values of capacitor 28 and inductor 30. FIG. 6 illustrates three quantities, namely a resistive current component, an inductive current component, and a required load current. The inductive component (i.e. the triangular waveform) is the maximum current which inductive converter 22 can provide, given a specific VCCin, VCCout, inductor 30 value and global average current. The resistive converter 24 provides the difference between the current provided by inductive converter 22 and the required load current.

As the minimum allowed VCCout gets closer to VCCin, it becomes harder to ensure that the variation in VCCout will never go below the minimum allowed value. For this reason, the control circuit 26 will detect when the minimal allowed VCCout is less that 300 millivolts (approximately) away from VCCin (see FIG. 4). In that case both CONTROLA and CONTROLB will be a logic level zero, CONTROLC will be a logic level zero, transistors 36 and 42 will be conducting and transistor 34 will not be conducting. As a result, VCCout will be forced to approximately the same voltage level as VCCin.

In one embodiment of the present invention, control circuit 26 compares VCCout to the appropriate thresholds (see FIG. 4) and controls transistors 34, 36, and 42 by changing the logic levels of signals CONTROLA, CONTROLC, and CONTROLB. FIG. 7 illustrates one possible embodiment of control circuit 26 of FIG. 2. In alternate embodiments of the present invention, control circuit 26 may be implemented using any appropriate combination of circuitry.

In the embodiment of the control circuit 26 illustrated in FIG. 9,the voltage comparator function is implemented as follows. The CLOCK signal 18 is applied to delay circuits 70–73 that represent the worst case delay in the integrated circuit core 12 that is regulated, plus an additional delay D1, D2, D3, or D4, respectively.

The worst case delay is a function of the intended operating frequency of integrated circuit core 12. The outputs of delay circuits 70–73 are sampled by the inverse edge of that same clock, namely CLOCK signal 18, using flip-flops 75–78, respectively. The polarity of the output of flip-flops 75 is an indication of VCCin relative to V4. In particular, state machine 91 uses the output of flip-flop 75 to help determine when to transition from state 60 to state 62 by way of path 64 (see FIG. 3). The polarity of the outputs of D flip-flops 76–78 is an indication of VCCout relative to V1, V2, and V3.

In one embodiment of the present invention, control circuit 26 prevents VCCout from being much higher than needed by using a "worst case" delay that is one half the period of CLOCK signal 18, or even less. In one embodiment, this is done by implementing the delay circuits 70–73 using a single delay line with taps, and then ANDing together several taps in the delay line and sampling the ANDing result rather than sampling only the end of the delay line.

If CLOCK signal 18 has a frequency lower than approximately 1 megahertz, control circuit 26 should either go into the "forced VCCout=VCCin" state 60 (see FIG. 3), or else control circuit 26 should biased signal CONTROLB, using stop mode bias circuit 90 (see FIG. 7), in order to produce a VCCout that is high enough for such low frequency operation.

To derive an estimated determination of whether "V4>VCCin", a similar delay line circuit is implemented, but this time the power supply voltage that is used is VCCin, instead of VCCout. The extra elements in this delay line are tuned to achieve 300 millivolts at slow conditions. If the difference is less than 300 millivolts, state machine 91 is transitioned into the "forced VCCout=VCCin" state 60 (see FIG. 3). Note that if the processing parameters of control circuit 26 cause delay circuit 70 to have a shorter delay, the control circuit 26 will limit VCCout oscillation (see FIG. 5) as the value of VCCout gets closer to VCCin. Note also that the various circuit elements illustrated in FIG. 9 are coupled to VGND 21 in the standard manner for such circuit elements (not shown).

Referring to FIG. 7, the stop mode bias circuit 90 works in parallel with control circuit 26. When control circuit 26 tri-states buffer 87 (i.e. makes the output of buffer 87 high-impedance), the stop mode bias circuit will slowly bias VCCout to about Vtn. A regulated power supply voltage of VCCout=Vtn is enough to allow integrated circuit core 12 to continue to store and retain data the during Stop Mode. Using the stop mode bias circuit 90 will reduce subthreshold currents in integrated circuit core 12, thus reducing leakage current and power consumption.

FIG. 8 illustrates one embodiment of a stop mode bias circuit 90 that may be used to provide a small amount of current to conductor 44 (see FIG. 7) when the output of buffer 87 is in a high-impedance state. The embodiment of the stop mode bias circuit 90 illustrated in FIG. 8 is a very stable three stage feedback circuit. Alternate embodiments of the present invention may use other circuits in place of stop mode bias circuit 90.

Referring to FIGS. 1 and 2, for different embodiments of the present invention, different portions of system 10 may be formed on the same integrated circuit. For example, in one embodiment of the present invention, all of the circuitry illustrated in FIG. 1 may be implemented on the same integrated circuit. In an alternate embodiment of the present invention, all of the circuitry illustrated in FIG. 1, except for inductor 30, capacitor 28, and diodes 32 and 40 (see FIG. 2), may be implemented on the same integrated circuit. If inductor 30, capacitor 28, and diodes 32 and 40 are not implemented on the same integrated circuit, then the integrated circuit may require two integrated circuit pins or bonding pad connections in order to complete the voltage regulator circuit 16 illustrated in FIG. 2.

In summation, the above specification describes a method and apparatus for regulating voltage in a system 10 (see FIG. 1) which utilizes integrated circuits. The present invention utilizes a voltage regulator circuit 16 which regulates the power supply voltage provided to a portion of an integrated circuit (i.e. core 12) that is capable of functioning with a regulated power supply voltage. The voltage regulator circuit 16 utilizes two voltage converting mechanisms, namely an inductive converter 22 and a resistive converter 24. The inductive converter 22 and the resistive converter 24 supplement each other in order to supply the current required by integrated circuit core 12. In some embodiments of the present invention, control circuit 26 minimizes the use of the resistive mechanism (i.e. resistive converter 24) in order to maximize the conversion efficiency. Voltage regulator 16 is able to supply abrupt current steps while not letting VCCout drop below a desired value. Under state machine 91 control (see FIG. 7), control circuit 26 can force voltage converter 16 to provide a regulated power supply voltage VCCout that is approximately equal to VCCin. Also under state machine 91 control, voltage regulator 16 can operate the integrated circuit core 12 at a minimal VCCout when the integrated circuit core 12 is in Stop Mode.

The present invention will reduce the power consumed by integrated circuit core 12 (see FIGS. 1 and 2) by a significant amount, both during normal operation and during Stop Mode. The exact power savings depends upon various parameters, such as the size of the integrated circuit core 12 and the size of the circuit elements used in voltage regulator 16. The basic idea behind the power saving is that a typical integrated circuit has a large voltage margin relative to its operating conditions of frequency and temperature. The reason for this voltage margin is due to various factors, such as fabrication process tolerance, production testing in extreme conditions rather than typical conditions, and design shrinks to increase frequency and reduce costs. For most systems 10 (see FIG. 1), the semiconductor area required by the voltage regulator circuit 16 is small compared to the semiconductor area required by the integrated circuit core 12.

While the present invention has been illustrated and described with reference to specific embodiments, further modifications and improvements will occur to those skilled in the art. For example, various modifications could be made to voltage regulator circuit 16. For instance, the values of inductive and capacitive elements could be modified. Transistor 34 (see FIG. 2) may be omitted. Also, in some instances passive elements could be used to replace active elements, and vice versa. For example, in alternate embodiments of the present invention, an active device such as a transistor could be used instead of a passive device such as a resistor or capacitor. Likewise a passive device could be used to replace an active device that was serving the function of a resistor or capacitor.

It is to be understood, therefore, that this invention is not limited to the particular forms illustrated and that it is intended in the appended claims to cover all modifications that do not depart from the spirit and scope of this invention.

We claim:

1. A circuit for performing adaptive power regulation for an integrated circuit, comprising:

an inductive converter, having an input coupled to a non-regulated first power supply voltage, and having an output coupled to a node;

a resistive converter, having an input coupled to the non-regulated first power supply voltage, and having an output coupled to the node;

a control circuit, having a first input coupled to the non-regulated first power supply voltage, having a second input coupled to the node for receiving a regulated first power supply voltage, having a first output for providing a first control signal to said inductive converter, and having a second output for providing a second control signal to said resistive converter;

digital circuitry, coupled to the node for receiving the regulated first power supply voltage; and a clock signal conductor, coupled to said control circuit and to said digital circuitry for providing a clock signal.

2. A circuit as in claim 1, further comprising:

a capacitive element, having a first terminal coupled to the node, and having a second terminal coupled to a second power supply voltage.

3. A circuit for performing adaptive power regulation for an integrated circuit, comprising:

an inductive converter, having an input coupled to a non-regulated first power supply voltage, and having an output coupled to a node;

a resistive converter, having an input coupled to the non-regulated first power supply voltage, and having an output coupled to the node;

a control circuit, having a first input coupled to the non-regulated first power supply voltage, having a second input coupled to the node for receiving a regulated first power supply voltage, having a first output for providing a first control signal to said inductive converter, and having a second output for providing a second control signal to said resistive converter;

digital circuitry, coupled to the node for receiving the regulated first power supply voltage; and a third input, coupled to said digital circuitry, for receiving a stop signal.

4. A circuit for performing adaptive power regulation for an integrated circuit, comprising:

an inductive converter, having an input coupled to a non-regulated first power supply voltage, and having an output coupled to a node;

a resistive converter, having an input coupled to the non-regulated first power supply voltage, and having an output coupled to the node;

a control circuit, having a first input coupled to the non-regulated first power supply voltage, having a second input coupled to the node for receiving a regulated first power supply voltage, having a first output for providing a first control signal to said inductive converter, and having a second output for providing a second control signal to said resistive converter;

digital circuitry, coupled to the node for receiving the regulated first power supply voltage; and a fourth input, coupled to said digital circuitry, for receiving a force signal.

5. A circuit for performing adaptive power regulation for an integrated circuit, comprising:

an inductive converter, having an input coupled to a non-regulated first power supply voltage, and having an output coupled to a node;

a resistive converter, having an input coupled to the non-regulated first power supply voltage, and having an output coupled to the node;

a control circuit, having a first input coupled to the non-regulated first power supply voltage, having a second input coupled to the node for receiving a regulated first power supply voltage, having a first output for providing a first control signal to said inductive converter, and having a second output for providing a second control signal to said resistive converter;

digital circuitry, coupled to the node for receiving the regulated first power supply voltage; and a third output, coupled to said digital circuitry, for providing a ready signal to said digital circuitry.

6. A circuit as in claim 1, wherein said inductive converter further comprises:

an inductive element having, a first terminal, and having a second terminal coupled to the node; and a first transistor, having a first current electrode coupled to the non-regulated first power supply voltage, having a second current electrode coupled to the first terminal of the inductive element, and having a gate electrode coupled to the first output of said control circuit for receiving the first control signal.

7. A circuit as in claim 6, wherein said inductive element has a value in a range of 20 microhenrys to 200 microhenrys.

8. A circuit for performing adaptive power regulation for an integrated circuit, comprising:

an inductive converter, having an input coupled to a non-regulated power supply and having an output coupled to a node, the inductive converter comprising:

an inductive element having a first terminal and a second terminal, the second terminal coupled to the output of the inductive converter;

a first transistor, having a first current electrode coupled to the input of the inductive converter, having a second current electrode coupled to a first terminal of the inductive element;

a second transistor, having a first current electrode coupled to the first terminal of the inductive element, having a second current electrode coupled to a reference power supply;

a diode having a first terminal coupled to the first terminal of the inductive element, and having a second terminal coupled to the reference power supply;

a resistive converter, having an input coupled to the non-regulated power supply, and having an output coupled to the node;

a control circuit, having a first input coupled to the non-regulated power supply, having a second input coupled to the node for receiving a first regulated power supply voltage, having a first output for providing a first control signal to said inductive converter, and having a second output for providing a second control signal to said resistive converter; and digital circuitry, coupled to the node for receiving the first regulated power supply voltage;

wherein the first transistor has a gate electrode coupled to the control circuit; and wherein the second transistor has a gate electrode coupled to the control circuit.

9. A circuit as in claim 8, wherein said first transistor is a p-channel field effect transistor and said second transistor is an n-channel field effect transistor.

10. A circuit for performing adaptive power regulation for an integrated circuit, comprising:

an inductive converter, having an input coupled to a non-regulated first power supply voltage, and having an output coupled to a node;

a resistive converter, having an input coupled to the non-regulated first power supply voltage, and having an output coupled to the node;

a control circuit, having a first input coupled to the non-regulated first power supply voltage, having a second input coupled to the node for receiving a regulated first power supply voltage, having a first output for providing a first control signal to said inductive converter, and having a second output for providing a second control signal to said resistive converter; and digital circuitry, coupled to the node for receiving the regulated first power supply voltage; and wherein the resistive converter comprises:

a diode, having a first terminal coupled to the non-regulated first power supply voltage, and having a second terminal coupled to the node; and a transistor, having a first current electrode coupled to the non-regulated first power supply voltage, having a second current electrode coupled to the node, and having a gate electrode coupled to the second output of said control circuit for receiving the second control signal.

11. A circuit as in claim 10, wherein said transistor is a p-channel field effect transistor.

12. A circuit as in claim 1, wherein said control circuit and said digital circuitry are located on a same integrated circuit, and a portion of said inductive converter is not located on the same integrated circuit.

13. A circuit as in claim 1, wherein said inductive converter, said resistive converter, said control circuit, and said digital circuitry are all located on a same integrated circuit.

14. A circuit as in claim 1, wherein said digital circuitry comprises:

a data processor core.

15. A circuit for performing adaptive power regulation for an integrated circuit, comprising:

a voltage regulator, said voltage regulator receiving a non-regulated first power supply voltage and providing a regulated first power supply voltage;

wherein said voltage regulator comprises:

a first voltage converter; and a second voltage converter;

wherein said circuit for performing adaptive power regulation further comprises:

a control circuit, couple to said voltage regulator, said control circuit receiving both the non-regulated first power supply voltage and the regulated first power supply voltage, said control circuit providing at least one control signal to said voltage regulator to selectively activate said first and second voltage converters based upon the non-regulated first power supply voltage and the regulated first power supply voltage;

digital circuitry, coupled to said voltage regulator, said digital circuitry receiving the regulated first power supply voltage; and a clock signal conductor coupled to said control circuit and to said digital circuitry for providing a clock signal.

16. A integrated circuit comprising:

a voltage regulator, said voltage regulator receiving a first non-regulated power supply voltage and providing a first regulated power supply voltage;

wherein said voltage regulator comprises:

a first voltage converter, the first voltage converter performs voltage conversion by using inductive elements: and a second voltage converter, wherein the second voltage converter is coupled to the first voltage converter and the second voltage converter performs resistive voltage conversion using non-inductive elements;

wherein said integrated circuit further comprises:

a control circuit, coupled to said voltage regulator, said control circuit receiving the first non-regulated power supply voltage, the first regulated power supply voltage, and a clock signal, said control circuit providing at least one control signal to said first voltage converter and at least one control signal to said second voltage converter;

a first integrated circuitry portion, said first integrated circuitry portion receiving the first regulated power supply voltage, the first integrated circuitry portion having a first operating frequency; and a second integrated circuitry portion, said second integrated circuitry portion receiving the first non-regulated power supply voltage;

wherein the first regulated power supply voltage is adjusted according the to the frequency; and wherein in response to a second operating frequency of the first integrated circuitry portion, said voltage regulator provides a second regulated power supply voltage adjusted according to the second operating frequency.

17. An integrated circuit as in claim 16, wherein the first regulated power supply voltage is a function of the first non-regulated power supply voltage, a first minimum operating voltage and the first operating frequency of the first integrated circuitry portion.

18. An integrated circuit as in claim 17, wherein said first regulated power supply voltage is in a range of voltage values determined by said first non-regulated power supply voltage and said first minimum operating voltage, and wherein said second regulated power supply voltage is in a second range of voltage values determined by said second non-regulated power supply voltage and a second minimum operating voltage.

19. An integrated circuit as in claim 18, wherein said voltage regulator has a plurality of ranges of regulated voltage values.

20. An integrated circuit as in claim 18, wherein the first regulated power supply voltage is a continuous voltage.

21. An integrated circuit as in claim 18, wherein the first voltage converter comprises an inductive circuit.

* * * * *